US005461373A

United States Patent [19]

Yamamoto et al.

[11] Patent Number: 5,461,373

[45] Date of Patent: Oct. 24, 1995

[54] RADIO CONTROL TRANSMITTER

[75] Inventors: Michio Yamamoto; Satoshi Inokoshi, both of Mobara, Japan

[73] Assignee: Futaba Denshi Kogyo K.K., Mobara, Japan

[21] Appl. No.: 76,686

[22] Filed: Jun. 15, 1993

Related U.S. Application Data

[63] Continuation of Ser. No. 849,836, Mar. 12, 1992, abandoned, which is a continuation of Ser. No. 310,359, Feb. 14, 1989, abandoned.

[30] Foreign Application Priority Data

Feb. 17, 1988 [JP] Japan ..... 63-18738 U

[51] Int. Cl.[6] ..... G08C 19/00

[52] U.S. Cl. ..... 340/825.69; 340/825.72; 455/92

[58] Field of Search ..... 455/92; 340/825.69, 340/825.72, 310 A; 446/456; 244/3.11, 189; 180/167

[56] References Cited

U.S. PATENT DOCUMENTS

| | | | |
|---|---|---|---|
| 3,793,636 | 2/1974 | Clark et al. | 340/825.69 X |
| 4,072,898 | 2/1978 | Hellman et al. | 340/825.69 X |
| 4,143,368 | 3/1979 | Route et al. | 455/603 X |
| 4,185,272 | 6/1980 | Feiker | 340/310 R |
| 4,413,261 | 11/1983 | Greenberg | 340/825.69 X |
| 4,739,311 | 4/1988 | Yamamoto et al. | 340/825.69 X |
| 4,760,392 | 7/1988 | Yamamoto et al. . | |
| 4,817,948 | 4/1989 | Simonelli | 446/456 X |

*Primary Examiner*—Ulysses Weldon

*Attorney, Agent, or Firm*—Oblon, Spivak, McClelland, Maier & Neustadt

[57] ABSTRACT

A radio control transmitter capable of carrying out transmitting and receiving of data on control characteristics of a stick, thereby to facilitate setting of the control characteristics. The transmitter includes a storage section for storing the control characteristics and a control section for controlling transmitting and receiving of data between the storage section and an external device connected to the transmitter.

8 Claims, 1 Drawing Sheet

RADIO CONTROL TRANSMITTER

This application is a continuation of application Ser. No. 07/849,836, filed on Mar. 12, 1992, now abandoned, which is a continuation of application Ser. No. 07/310,359, filed on Feb. 14, 1989, now abandoned

BACKGROUND OF THE INVENTION

1. Field of the Invention

This invention relates to a radio control transmitter, and more particularly to a radio control transmitter for the remote control of model cars, aircrafts, boats and the like.

2. Background of the Invention

Radio control transmitters for the remote control of model; cars, aircrafts, boats and the like available to date are designed to effect a variety of functions for controlling the model units in various ways.

For example, Japanese Patent Application Laying-Open Publication No. 122685/87 discloses a radio control transmitter in which trim positions for fine adjustment of a neutral position of a stick are stored in a memory so that a desired trim position representing the neutral position of the stick may be selected depending on each of the model units. Also, Japanese Patent Application Laying-Open Publication No. 217988/1987 discloses a radio control transmitter which permits an order of channel signals to change depending on a model unit to establish its control characteristics.

Each of these radio control transmitters is advantageous in that it can be used in multiple model units by adjusting a setting switch provided on a body of the transmitter so that desired control characteristics of the transmitter may be established depending on the model units. However, the setting operation of the switch is highly troublesome and it is extremely difficult for a beginner to obtain optimal setting of desired control characteristics of the transmitter when multifunctional control characteristics are established or when there are a variety of model units to control.

SUMMARY OF THE INVENTION

The present invention has been made in view of the foregoing disadvantages of the prior art.

Accordingly, it is an object of the present invention to provide a radio control transmitter which is capable of readily establishing desired control characteristics of the transmitter depending on a model unit.

In accordance with the present invention, a radio control transmitter is provided. The radio control transmitter comprises a setting section for setting control characteristics of a stick, a storage section for storing the control characteristics therein, an analog-digital converter section for outputting a digital signal depending on operation of the stick, an operation section for carrying out processing using the digital output signal of the analog-digital converter and an output signal of the storage section, a parallel-serial converter section for converting an output signal of the operation section into a serial signal, a high-frequency circuit section for modulating an output signal of the parallel-serial converter section and outputting it, and a control section for controlling transmitting and receiving of a data between the storage section and an external device.

BRIEF DESCRIPTION OF THE DRAWINGS

These and other objects and many of the attendant advantages of the present invention will be readily appreciated as the same becomes better understood by reference to the following detailed description when considered in connection with the accompanying drawing; wherein.

DETAILED DESCRIPTION OF THE PREFERRED EMBODIMENT

Figure 1:
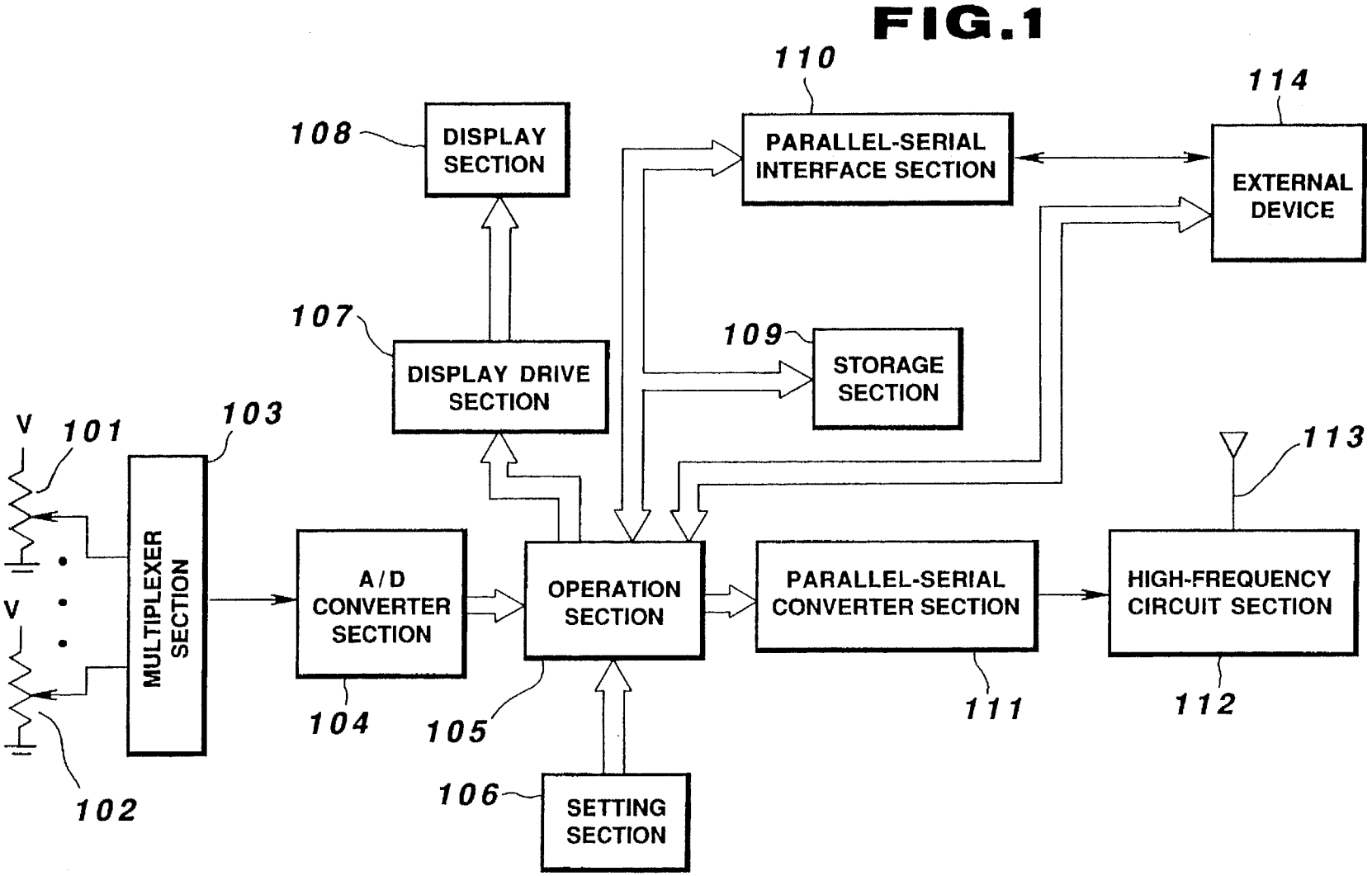
FIG. 1 is a block diagram showing an embodiment of a radio control transmitter according to the present invention.

FIG. 1 shows an embodiment of a radio control transmitter according to the present invention.

A radio control transmitter of the illustrated embodiment includes variable resistors 101 and 102 each connected at one end thereof to a DC power supply V and a multiplexer section 103 commonly connected to the resistors 101 and 102. The resistors 101 and 102 each are adapted to supply an analog signal of a voltage depending on the amount or magnitude of control of a stick (not shown) to the multiplexer section 103. The multiplexer section 103 supplies the analog signal to an A/D converter section 104 in a predetermined order depending on each of the channels. The A/D converter section 104 converts the analog signal supplied from the multiplexer section 103 into a parallel digital signal, which is then supplied to an operation section 105. The radio control transmitter also includes a setting section 106 connected to the operation section 105, which includes a setting switch for setting various control characteristics of the stick, such as, for example, exponential, mixing and the like, and a switch for controlling transmitting and receiving of data between a body of the radio control transmitter and an external equipment or device. Control characteristics of the stick determined by operation of the setting switch in the setting section 106 are stored in a storage section 109. The operation section 105 carries out processing of an output signal of the A/D converter section 104 and data stored in the storage section 109, and then supplies a parallel digital signal obtained by the processing to a parallel-serial converter section 111. The parallel-serial converter section 111 converts the parallel digital signal from the operation section 105 into a serial signal, which is then supplied to a high-frequency circuit section 112. The high-frequency circuit section 112 carries out frequency modulation (FM) of the serial signal and then supplies the modulated serial signal through an antenna 113 to a model unit to control (not shown) in the form of a control signal. Thus, the model unit can be controlled on the basis of characteristics established in the setting section 106 depending on operation of the stick. The operation section 105 supplies a signal corresponding to operation of the stick and the like to a display drive section 107 for driving a display section 108. The display section 108 is adapted to carry out display of a graph or the like indicating driving of a servo motor provided in the model unit to control.

Now, the manner of transmitting and receiving of data on control characteristics of the stick which is carried out between the body of the transmitter and an external device 114 to be connected to the transmitter body such as an external storage device, a personal computer or the like will be described.

First, transmitting of the data to the external device 114 will be described.

Control characteristics of the stick, such as, exponential, mixing and the like are determined by the setting section 106 and the data is stored in the storage section 109. In this state, the external device 114 is connected to the transmitter as shown in FIG. 1. Then, a transmit command representing data on mixing and the like which is going to be sent to the external device 114 is input to the operation section 105 through the switch in the setting section 106. In response to input of the command, the operation section 105 generates a signal indicating the data is sent to the external device 114. When the operation section 105 receives a signal from the external device indicating that the external device is in the state capable of receiving the data, only designated data stored in the storage section 109 are supplied to a parallel-serial interface section 110 in order. The interface section 110 converts the input signal into a serial signal and then supplies it to the external device 114.

Concurrently, the display section 108 carries out display indicating that the data is being sent.

Now, receiving of the data from the external device 114 which indicates control characteristics of the stick will be described.

After connection between the transmitter and external device 114 is made as shown in FIG 1, a receive command signal representing that data from the external device 114 is going to be received is supplied to the operation section 105 through the switch in the setting section 106. In response to the supply, the operation section 105 supplies a signal indicating that it is in a receiving state to the external device 114. Serial data from the external device 114 are converted into a parallel signal by the parallel-serial interface section 110 and then stored in order in addresses in the storage section 109 which are designated by the operation section 105. Concurrently, the display section 108 carries out display indicating that the data is being received. Completion of receiving of the data indicates the completion of the setting of control characteristics of the stick. Accordingly, operation of the stick permits the model unit to set control characteristics similar to the control characteristics stored in the external device 114. Also, the radio control transmitter of the illustrated embodiment permits control characteristics of the stick to be readily set without any troublesome operation.

In the embodiment described above, one external device is connected to the transmitter. However, a plurality of external devices may be connected to the transmitter in parallel, resulting in concurrent transmitting and receiving of data with respect to the devices. Also, a storage unit such as a floppy disc or a tape recorder, a personal computer, a radio control transmitter, or the like may be used as the external device. In particular, when a radio control transmitter is used as an external device, setting of optimal control characteristics on one of the transmitters facilitates setting of optimal control characteristics of the other transmitter due to transmitting and receiving of data. Further, connection of a personal computer to the transmitter of the illustrated embodiment permits simulation of operation, data filing and the like due to its data processing.

As can be seen from the foregoing, the radio control transmitter of the present invention is so constructed that the data on control characteristics of the stick may be transmitted and received between the transmitter and the external device, resulting in highly facilitating setting of the control characteristics.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed as new and desired to be secured by Letters Patent of the United States is:

1. A radio control transmitter comprising:

signal generating means for generating an analog signal based on an operation of a control stick;

a setting section for setting control characteristics for operation of the control stick;

means for connecting said transmitter to an external device, the external device receiving and storing said control characteristics set in the setting section;

a storage section for receiving the control characteristics stored in the external device and for storing said control characteristics therein;

an analog-digital converter section for receiving the analog signal based on the operation of the control stick from the signal generating means and for outputting a digital signal depending on operation of said control stick;

an operation section for carrying out processing using a digital output signal of said analog-digital converter and an output signal of said storage section;

a parallel-serial converter section for converting an output signal of said operation section into a serial signal;

a high-frequency circuit section for converting an output signal of said operation section into a serial signal;

a high-frequency circuit section for modulating the serial signal output from said parallel-serial converter section and outputting it; and means for operating said transmitter in accordance with the control characteristics stored in said storage section.

2. The radio control transmitter as defined in claim 1, wherein said control section comprises a parallel-serial interface for converting data in said storage section into a serial signal and transmitting said data to said external device in the form of a serial signal.

3. The radio control transmitter as defined in claim 1, wherein said control section comprises a parallel-serial interface for converting data in the form of serial signal received from said external device into a parallel signal and supplying said parallel signal to said storage section to have said parallel signal stored in order in addresses designated by said operation section.

4. The radio control transmitter as defined in claim 1, wherein the signal generating means comprises at least one variable resistor.

5. A radio control transmitter comprising:

signal generating means for generating an analog signal based on an operation of a control stick;

a setting section for setting control characteristics for operation of the control stick;

means for connecting said transmitter to an external device, the external device receiving and storing said control characteristics set in the setting section;

a storage section for receiving the control characteristics stored in the external device and for storing said control characteristics therein;

an analog-digital converter section for receiving the analog signal based on the operation of the control stick from the signal generating means and for outputting a digital signal depending on operation of said control stick;

an operation section for carrying out processing using a digital output signal of said analog-digital converter and an output signal of said storage section;

a parallel-serial converter section for converting an output signal of said operation section into a serial signal;

a high-frequency circuit section for converting an output signal of said operation section into a serial signal;

a high-frequency circuit section for modulating the serial signal output from said parallel-serial converter section and outputting it; and means for operating said transmitter in accordance with the control characteristics stored in said storage section.

6. The radio control transmitter as defined in claim 5, wherein said means for transferring control characteristics comprises a parallel-serial interface for converting data in said storage section into a serial signal and transmitting said data to said external device in the form of a serial signal.

7. The radio control transmitter as defined in claim 5, wherein said means for transferring control characteristics comprises a parallel-serial interface for converting data in the form of a serial signal received from said external device into a parallel signal and supplying said parallel signal to said storage section to have said parallel signal stored in order in addresses designated by said operation section.

8. The radio control transmitter as defined in claim 5, wherein the signal generating means comprises at least one variable resistor.

* * * * *

UNITED STATES PATENT AND TRADEMARK OFFICE

CERTIFICATE OF CORRECTION

PATENT NO. : 5,461,373

DATED : October 24, 1995

INVENTOR(S) : Michio YAMAMOTO, et al.

It is certified that error appears in the above-indentified patent and that said Letters Patent is hereby corrected as shown below:

On the title page, Item [30], the Foreign Application Priority Number should read:

--63-018738--

Signed and Sealed this

Twenty-third Day of January, 1996

*Attest:*

Bruce Lehman

BRUCE LEHMAN

*Attesting Officer*

*Commissioner of Patents and Trademarks*